US007328480B2

(12) United States Patent
Schoemann

(10) Patent No.: US 7,328,480 B2
(45) Date of Patent: Feb. 12, 2008

(54) COEXTRUDED LIVING HINGE, A COMPONENT INCORPORATING THE HINGE, AND METHODS OF MAKING THE COMPONENT

(75) Inventor: Michael P. Schoemann, Waterford, MI (US)

(73) Assignee: International Automotive Components Group North America, Inc., Dearborn, MI (US)

( * ) Notice: Subject to any disclaimer, the term of this patent is extended or adjusted under 35 U.S.C. 154(b) by 841 days.

(21) Appl. No.: 10/268,557

(22) Filed: Oct. 10, 2002

(65) Prior Publication Data

US 2004/0078929 A1 Apr. 29, 2004

(51) Int. Cl.
*E05D 1/00* (2006.01)

(52) U.S. Cl. ..... 16/225; 16/372; 16/226; 16/223; 16/385

(58) Field of Classification Search ..... 16/221, 16/223, 225, 226
See application file for complete search history.

(56) References Cited

U.S. PATENT DOCUMENTS

| | | | | | |
|---|---|---|---|---|---|
| 403,713 | A | * | 5/1889 | Zattau | 16/291 |
| 3,232,333 | A | * | 2/1966 | Dixon | 160/183 |
| 3,441,975 | A | * | 5/1969 | Shepherd | 16/225 |
| 3,460,282 | A | * | 8/1969 | Swirsky | 40/530 |
| 3,516,114 | A | * | 6/1970 | Joyce | 16/225 |
| 3,628,215 | A | * | 12/1971 | Everburg | 16/293 |
| 4,387,128 | A | * | 6/1983 | Emms et al. | 428/60 |
| 4,463,046 | A | * | 7/1984 | Hutchison et al. | 428/156 |
| 4,476,174 | A | * | 10/1984 | Carrera | 428/58 |
| 4,537,003 | A | * | 8/1985 | Huber et al. | 52/396.05 |
| 4,563,381 | A | * | 1/1986 | Woodland | 428/156 |
| 4,776,928 | A | | 10/1988 | Perlich | |
| 4,828,132 | A | * | 5/1989 | Francis et al. | 220/6 |
| 4,879,854 | A | * | 11/1989 | Handler | 52/238.1 |
| 5,001,877 | A | * | 3/1991 | Edwards | 52/288.1 |
| 5,015,028 | A | * | 5/1991 | Bonnett | 160/231.1 |
| 5,073,428 | A | * | 12/1991 | Lancelot et al. | 428/67 |
| 5,265,308 | A | | 11/1993 | May et al. | |
| 5,450,694 | A | * | 9/1995 | Goranson et al. | 52/71 |
| 5,538,178 | A | * | 7/1996 | Zink et al. | 229/117.01 |
| D372,852 | S | * | 8/1996 | Noll et al. | D8/328 |
| 5,549,801 | A | | 8/1996 | Perlich et al. | |

(Continued)

FOREIGN PATENT DOCUMENTS

GB 2285084 A * 6/1995

(Continued)

*Primary Examiner*—Patricia Engle
*Assistant Examiner*—Mark Williams
(74) *Attorney, Agent, or Firm*—Brooks Kushman P.C.

(57) ABSTRACT

A living hinge comprising a spring portion having a first end and a second end and a first arm portion and a second arm portion coextruded with the spring portion is disclosed. The first arm portion extends from the first end and the second arm portion extends from the second end. A component having the living hinge is also disclosed. Methods of making the component having the living hinge are also discloses.

21 Claims, 5 Drawing Sheets

U.S. PATENT DOCUMENTS 5,729,867 A * 3/1998 Carmichael ..... 16/225
5,772,190 A 6/1998 May et al.
5,785,280 A * 7/1998 Baghdasarian ..... 244/173
6,003,203 A * 12/1999 Fowlston ..... 16/225
6,035,569 A 3/2000 Nagel et al.
6,098,247 A * 8/2000 Santelli, Jr. ..... 16/225
6,102,464 A * 8/2000 Schneider et al. ..... 296/37.3
6,380,484 B1 * 4/2002 Theis et al. ..... 174/68.3
6,381,891 B1 * 5/2002 Hazel ..... 40/640
6,554,148 B1 * 4/2003 Fernandez ..... 220/4.33
6,948,719 B2 * 9/2005 Dron ..... 277/628

FOREIGN PATENT DOCUMENTS

WO WO 02/090137 A2 * 11/2002

* cited by examiner

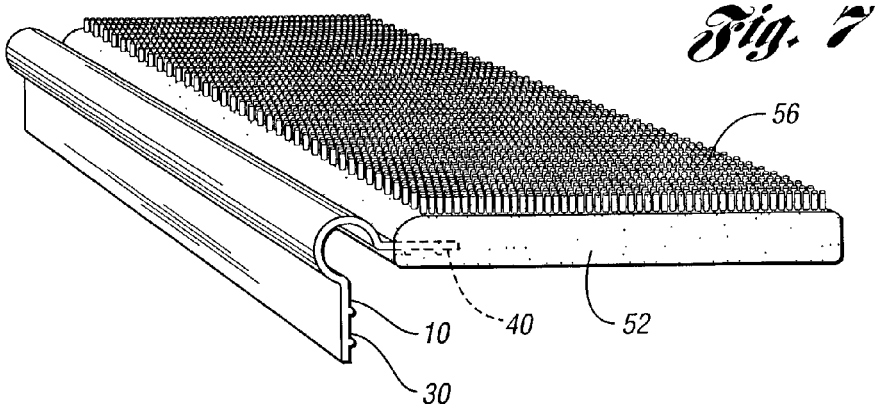
Fig. 7
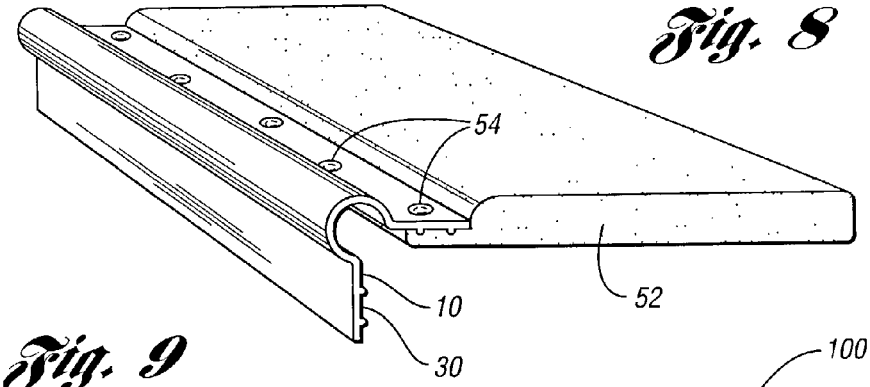
Fig. 8
Fig. 9
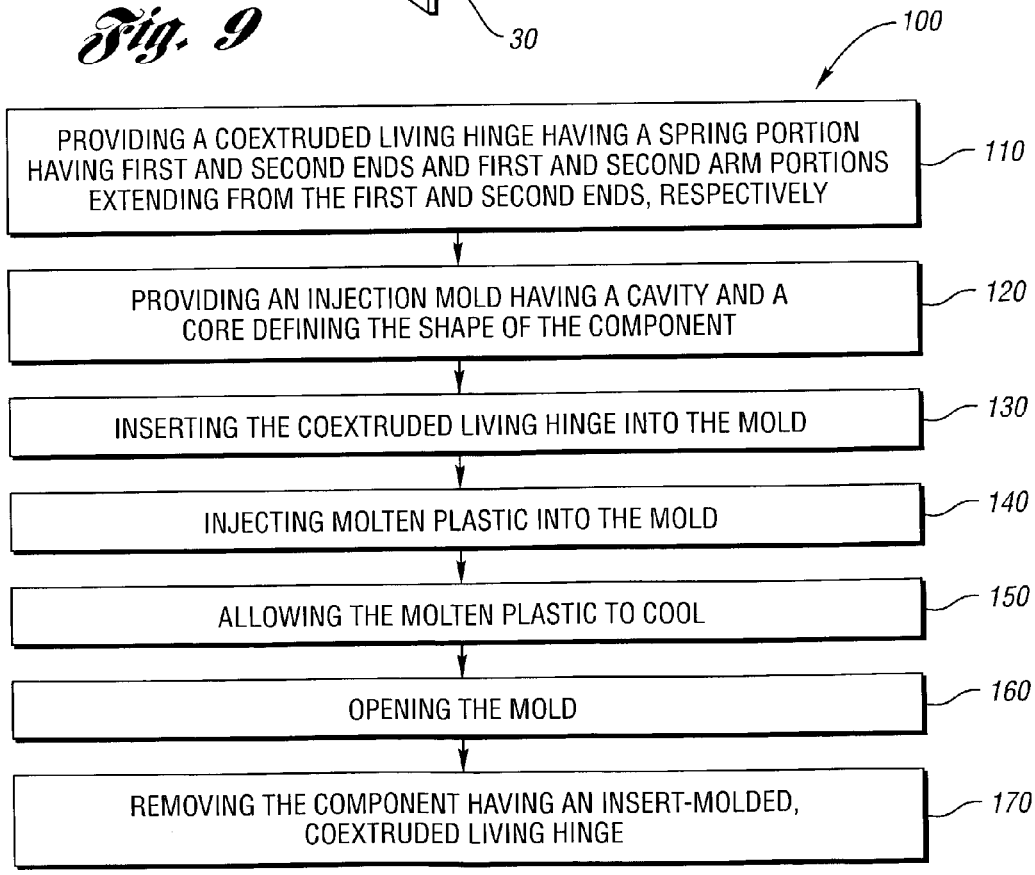

COEXTRUDED LIVING HINGE, A COMPONENT INCORPORATING THE HINGE, AND METHODS OF MAKING THE COMPONENT

BACKGROUND OF THE INVENTION

1. Field of the Invention

The present invention relates to a coextruded living hinge, a component having a coextruded living hinge, and methods of making a component having a coextruded living hinge.

2. Background Art

Many components, such as blow-molded, injection molded, compression molded, or routered vehicle load floors, stowage doors, or console armrests have pivot points to allow the component to properly flex during use. To permit proper flexion without cyclic fatigue and failure, a portion of the load floor or other component is removed and a metal hinge is assembled thereto in subsequent assembly steps. These additional steps and materials add to the cost and time to manufacture the load floor or other component. Further, the metal hinge must be removed from the load floor or other component before the load floor or other component can be recycled.

Accordingly, a need exists to design components with inexpensive, flexible pivots that are capable of withstanding repeated cyclic loading. The component may include a hinge that incorporates spring function therein.

SUMMARY OF THE INVENTION

Accordingly, it is an object of this invention to provide a hinge that withstands repeated cyclic loading and is inexpensive to manufacture, a component including the hinge, and methods of making components having the hinge. The hinge may also incorporate spring function therein.

The present invention discloses a component comprising a panel or substrate and a coextruded living hinge secured to the substrate. The living hinge has a spring portion having a first and a second end and first and second arm portions. The first arm portion extending from the first end and the second arm portion extending from the second end.

The present invention also discloses a living hinge comprising a spring portion having a first end and a second end and a first arm portion and a second arm portion coextruded with the spring portion. The first arm portion extends from the first end and the second arm portion extends from the second end arm. The angle between the arm portions is between 45° and 180°.

Further, the present invention also discloses a living hinge comprising a spring portion having a first end and a second end and a first arm portion and a second arm portion extruded with the spring portion. The first arm portion extends from the first end and the second arm portion extends from the second end arm. At least one of the first and second arm portions has at least one longitudinal rib thereon.

The invention also discloses at least three methods of making the component having a living hinge including injection molding, compression molding, and blow molding.

The above objects and other objects, features, and advantages of the present invention are more readily understood from a review of the attached drawings and the accompanying specification and claims.

BRIEF DESCRIPTION OF THE DRAWINGS

FIG. 7 is a perspective view of a carpeted component including the coextruded living hinge of the present invention;

FIG. 8 is a perspective view of a grained component including the coextruded living hinge of the present invention;

FIG. 9 is a flow chart illustrating a method of making the making a component having the coextruded living hinge of the present invention;

DETAILED DESCRIPTION OF THE PREFERRED EMBODIMENT(S)

Figure 1:
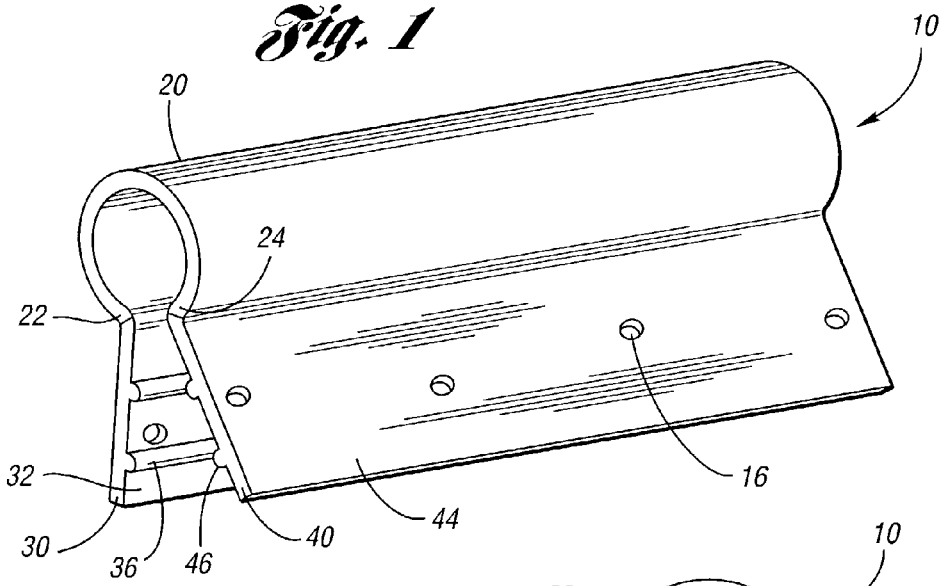
FIG. 1 is a perspective view of the coextruded living hinge of the present invention.
Figure 2:
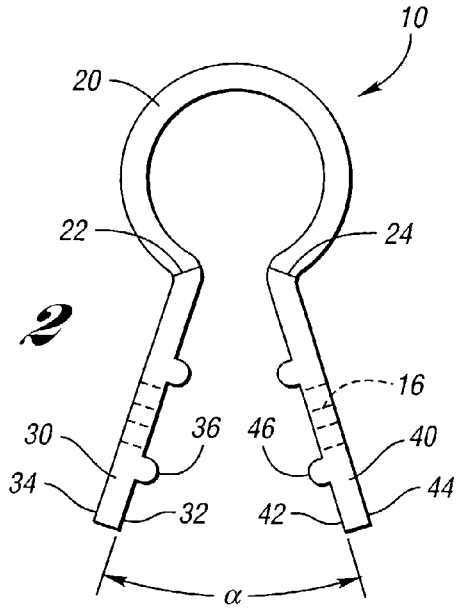
FIG. 2 is a cross-sectional view of the coextruded living hinge of the present invention.
Figure 3:
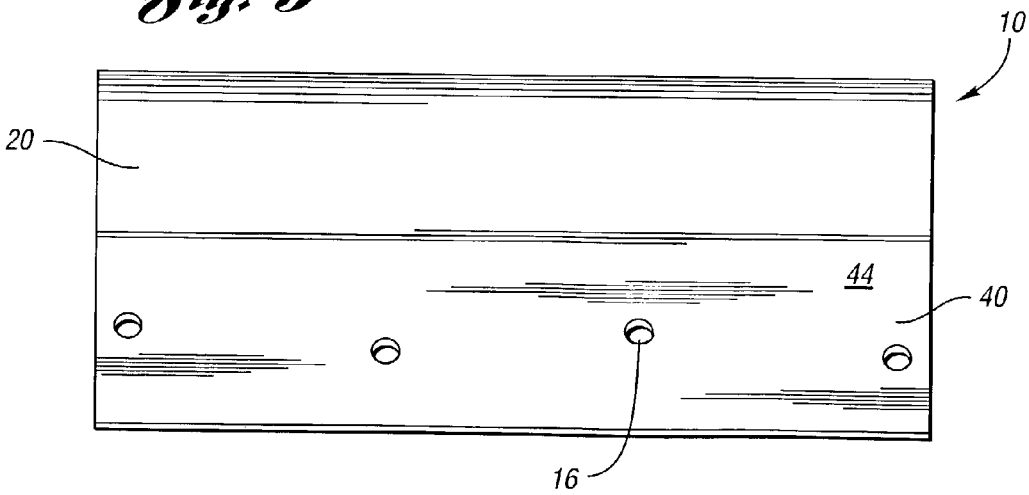
FIG. 3 is a front view of the coextruded living hinge of the present invention.

Referring now to FIGS. 1-3, a coextruded living hinge 10 according to the present invention is shown. The coextruded living hinge has a spring portion 20 having first and second ends 22 and 24. Preferably, the spring portion 20 is semicircular. However, certain applications may require a spring portion shaped otherwise and may even include arm portions.

A first arm portion 30 extends from the first end 22 of the spring portion. A second arm portion 40 extends from the second end 24 of the spring portion. The first and second arm portions 30, 40 have inner surfaces 32, 42 that face each other and outer surfaces 34, 44, respectively. Ribs 36, 46 on the inner surfaces 32, 42 of the first and second arm portions 30, 40 may be included to provide extra rigidity to the coextruded living hinge 10. Alternatively, ribs may be provided on the outer surfaces 34, 44 of the first and second arm portions 30, 40.

Preferably, the angle $\alpha$ between the arm portions 30, 40 is between 45 and 180 degrees. More preferably, the angle a between the arm portions 30,40 is between 45 and 90 degrees. Most preferably, the angle $\alpha$ between the arm portions 30, 40 is approximately 60 degrees.

The coextruded living hinge 10 is manufactured by coextruding at least two different materials—a first material for the spring portion 20 and a second material for the arm portion 30, 40. The materials must molecularly bond to each other to provide sufficient strength. Preferably, the spring portion 20 will be manufactured out of a thermoplastic polyester elastomer such as Hytrel® available from DuPont Plastics and the arm portions 30, 40 manufactured out of polyvinyl chloride (PVC). Thermoplastic polyester elastomers are ideal for parts requiring excellent flex fatigue and broad use temperature. Also, thermoplastic polyester elastomers are strongly resistant to tearing, flex-cut growth, creep and abrasion and have rebound characteristics that provide molded material memory.

By selecting different materials, different spring functions can be obtained. However, the spring portion should not be made so stiff that it is not capable of bending or elongating at the inner surface flex point. Also, the arm portions should not be made so flexible that the arm portions deform and do not allow the hinge to operate.

A component 50, such as, a load floor, flipper panel, stowage door, console armrest, or other automotive component that requires a hinge with or without spring function for a motor vehicle, having a panel or substrate 52 may be designed incorporating the coextruded living hinge 10 of the present invention. The panel or substrate 52 may be flat, contoured, boxed, or comprise any other shape. The component 50 and panel or substrate 52 may be plastic, wood, particle board, fiberboard, or other material. This application will refer to the component as a load floor although the component may be any other automotive component that requires a hinge. A load floor is installed in a motor vehicle and has a predetermined flex point to withstand cyclic loading.

Current load floors may be injection molded, compression molded, blow molded, or routered from wood or particle board and, in a subsequent operation, a portion of the load floor has a metal hinge attached thereto (not shown). The metal hinge is attached to the component using, for example, fasteners, heat staking, or rivets. At the end of the useful life of the component, the metal hinge must be removed prior to recycling the plastic component.

According to the present invention, the coextruded living hinge 10 may be made integral to the component 50 thereby eliminating several manufacturing steps. Further, the plastic coextruded living hinge 10 can be simply recycled along with the plastic component 50 thereby eliminating additional steps even after the useful life of the product. However, the coextruded living hinge 10 may be attached to a formed component in subsequent operations using, for example, fasteners, heat staking, rivets, adhesives, or other techniques.

Figure 4:
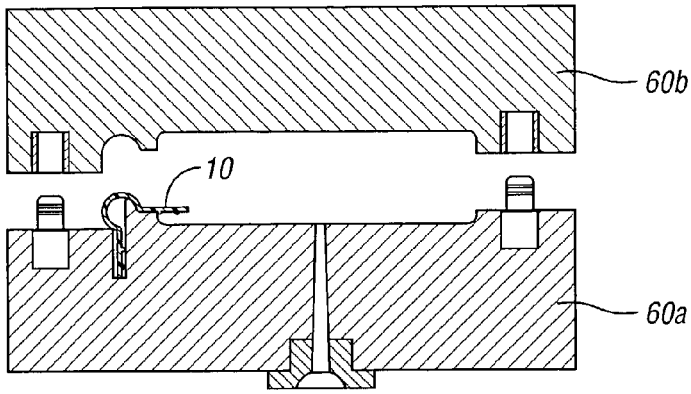
FIG. 4 is a cross-sectional view of a mold used in the injection molding process for the manufacture of the component of the present invention.

Typically, the load floors 50 are either injection-molded, compression molded, or blow molded out of plastic materials such as, but not limited to polyethylene, a polycarbonate/acrylic butadiene styrene polymer (PC/ABS), or filled polypropylene. Additionally, the load floors may be made out of wood, particle board, or wood fiber, fiberboard, or other materials. Referring now to FIG. 4, in injection molding, the coextruded living hinge is inserted into one of the mold halves 60*a*, 60*b* while the mold is open. The mold halves 60*a*, 60*b* are then brought into contact with each other and hot molten plastic is injected therebetween. The hot molten plastic bonds or forms a mechanically lock 54 to the coextruded living hinge 10 by flowing through holes or openings 16 making an integral part as shown in FIGS. 7 and 8. The arm portion 40 of the coextruded living hinge 10 may have a plurality of holes or openings 16 therethrough through which the molten plastic flows. A cavity on the mold half behind the hole 16 allows for the molten plastic to collect to form the mechanical lock 54. The panel or substrate 52 may completely lock the arm portion 40 as shown in FIG. 7, or, the panel or substrate 52 may partially lock the arm portions as shown in FIG. 8. In this as well as in the other processes and components described herein, the panel or substrate 52 may be covered with a carpet 56 either after removing the panel or substrate from the mold, or, alternatively, the carpet may be insert-molded with the panel or substrate during the molding process. After the component cools, the mold halves 60*a*, 60*b* separate and the component is removed.

As discussed above the coextruded living hinge may be attached to the plastic component in a subsequent operation.

Figure 5:
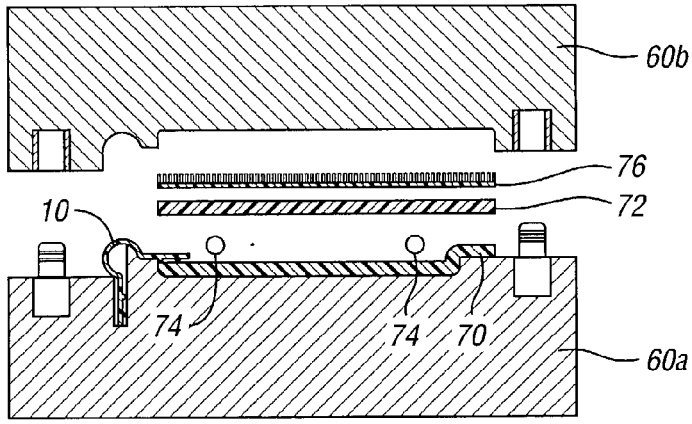
FIG. 5 is a cross-sectional view of a mold used in the compression molding process for the manufacture of the component and the component of the present invention.

Referring now to FIG. 5, in a compression molding operation, a first sheet 70 of compression molding material is placed in a first mold half 60*a* of a compression mold. The first sheet 70 of compression molding material may be a polyethylene, a polycarbonate/acrylic butadiene styrene polymer (PC/ABS), or filled polypropylene wood stock or another material. The first sheet 70 may be heated and formed prior to placing it into the first mold half 60*a* or in the first mold half itself. Vacuum forming or thermoforming operations may be used to form the sheet 70. A coextruded living hinge 10 is placed in the first mold half 60*a* and at least partially over the first sheet 70. A second sheet 72 of compression molding material is then placed over the first sheet. Similarly, the second sheet 72 may be heated and formed prior to placing it into the first mold half 60*a*. A second mold half 60*b* is then brought into contact with the first mold half 60*a*. Air may be blown through blow pins 74 to prevent the second sheet 72 from collapsing or to force the first and second sheets 70, 72 against the first and second mold halves 60*a*, 60*b*. A surface covering 76, such as a carpet layer, may be inserted over one of the sheets to integrally form a component having a surface layer. The mold halves 60*a*, 60*b* then separate and the component is removed.

Additionally, the coextruded living hinge 10 may be attached to one of the sheets 70, 72 before the sheet is inserted into the mold. Further, the coextruded living hinge 10 may be secured to the finished part after it is formed.

Figure 6:
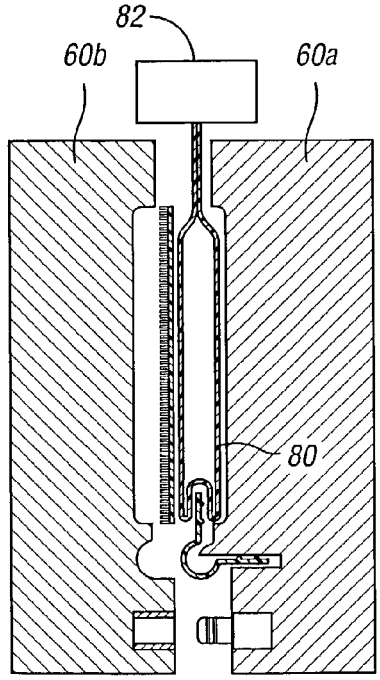
FIG. 6 is a cross-sectional view of a mold used in the blow molding process for the manufacture of the component and the component of the present invention.

Referring now to FIG. 6, in a blow-molding operation, a coextruded living hinge 10 is placed in a mold half 60*a*. A parison 80 is dropped from an extruder 82 between two mold halves 60*a*, 60*b*. The mold halves 60*a*, 60*b* then close about the parison 80. After the mold halves 60*a*, 60*b* have closed, air is blown into the parison 80 using known techniques, thereby blowing the parison into the shape of the finished part. The blown parison 80 is also forced against the coextruded living hinge 10. As the blown parison cools, the parison and the coextruded living hinge 10 bond together. When the parison 80 has sufficiently cooled, the mold halves 60*a*, 60*b* are opened and the finished part having an insert-molded, coextruded living hinge 10 is removed.

Alternatively, the coextruded living hinges 10 could be attached to a component such as a load floor, stowage door, flipper panel, or any other automotive component that requires a hinge with or without spring function by simply by removing a portion a portion of the component and securing the coextruded living hinge to the component using adhesive, fasteners, or other techniques or attaching the hinge to a portion of the component. The component may be made out of plastic, wood, particle board, fiberboard, or other material.

Referring now to FIG. 9, a method of making a component having a living hinge is shown generally denoted as 100. At step 110, a coextruded living hinge having a spring portion having first and second ends and first and second arm portions extending from the first and second ends, respectively, is provided. At step 120, an injection mold having a cavity and a core defining the shape of the component is provided. The coextruded living hinge is inserted into the mold at step 130. Next, molten plastic is injected into the mold and allowed to cool at steps 140 and 150. The mold is then opened and the component having an insert-molded, coextruded living hinge is removed at steps 160 and 170, respectively.

Figure 10:
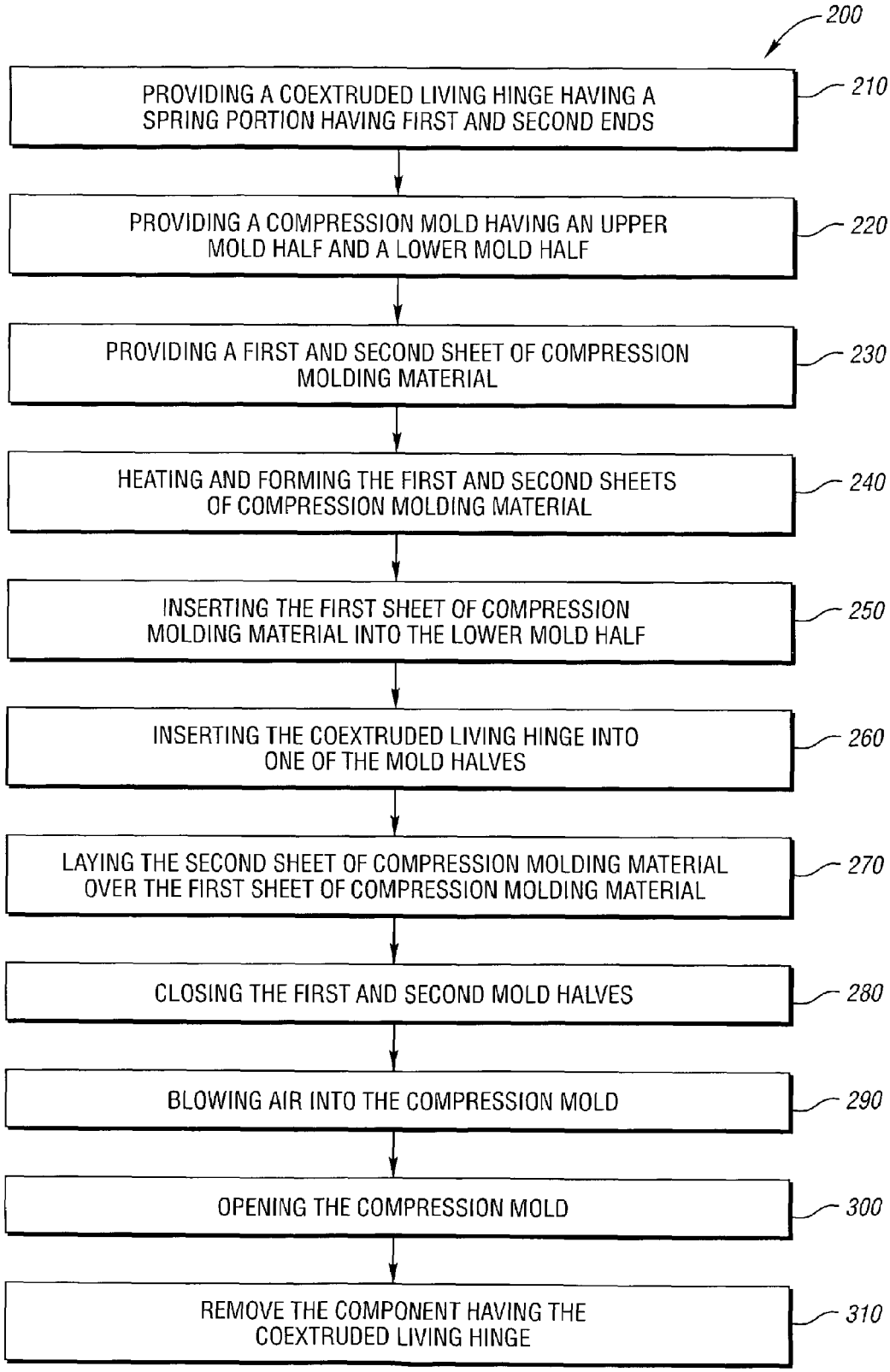
FIG. 10 is a flow chart illustrating another method of making the making a component having the coextruded living hinge of the present invention.

Referring now to FIG. 10, a compression molding method for making a component having a living hinge using compression molding is disclosed generally denoted as 200. The method comprises a first step 210 of providing a coextruded living hinge having a spring portion having first and second ends and first and second arm portions extending from the first and second ends respectively. Step 220 includes providing a compression mold having an upper mold half and a lower mold half. A first and a second sheet of compression molding material is provided at 230. The first and second sheets of compression molding material may be heated and formed at step 240. As discussed above, the first sheet may be formed in the mold half or in a separate mold: The first sheet of compression molding material is inserted into the lower mold half at step 250. At step 260, the coextruded living hinge is inserted into one of the mold halves. The second sheet of compression molding material is layered over the first sheet of compression molding material at step 270. Next, the first and second mold halves are closed at step 280. Air may be blown into the compression mold between the first and second mold halves at step 290. The mold is opened and the part is removed at steps 300 and 310 respectively.

Figure 11:
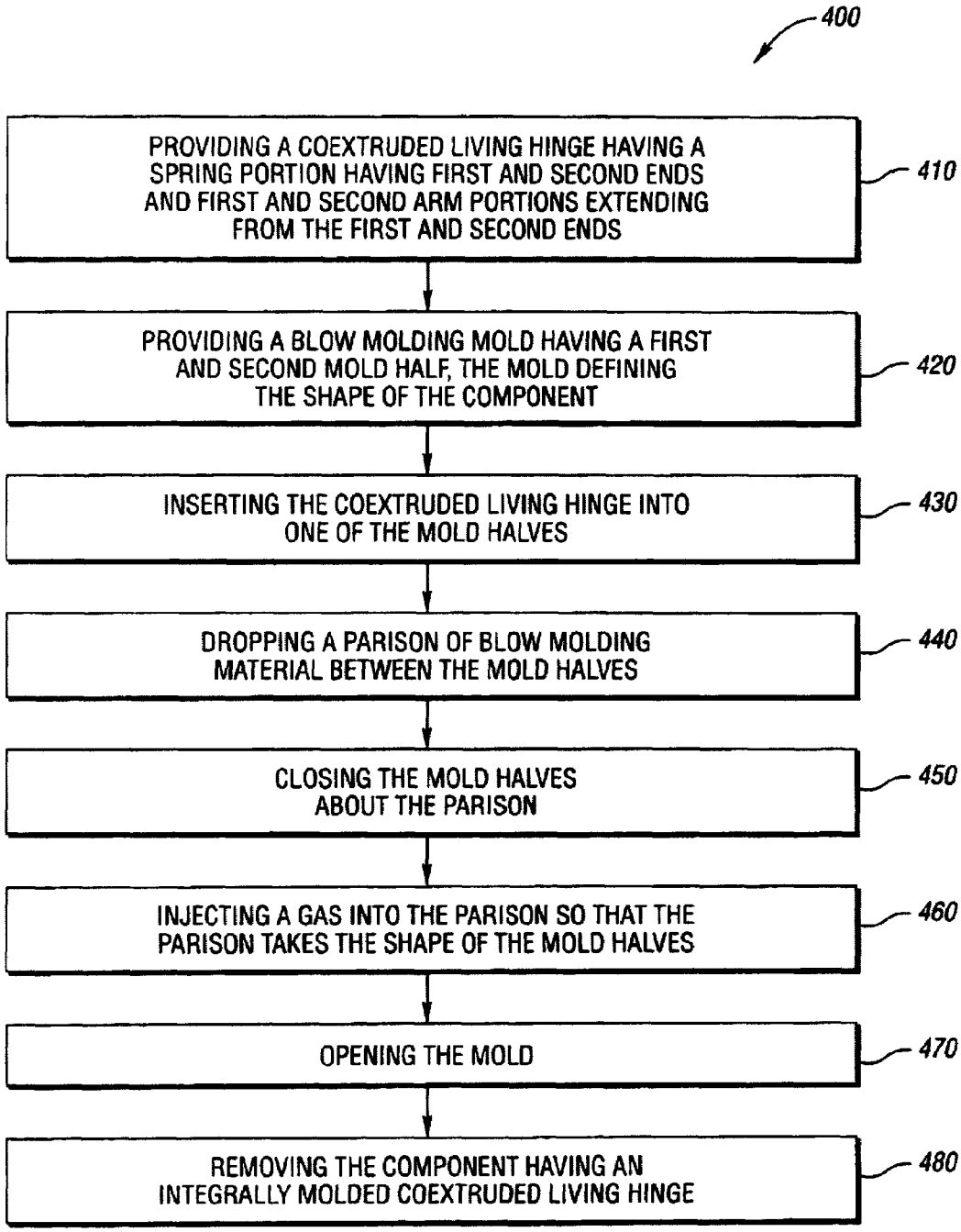
FIG. 11 is a flow chart illustrating yet another method of making the making a component having the coextruded living hinge of the present invention.

A method of blow molding a component having a living hinge is illustrated in FIG. 11 and denoted generally as 400. Step 410 comprises providing a coextruded living hinge having a spring portion having first and second ends and first and second arm portions extending from the first and second ends respectively. Step 420 includes providing a blow mold having a first and a second mold half, the mold defining the shape of the component. The coextruded living hinge is inserted into one of the mold halves at step 430. Next, a parison of blow molding material is dropped between the mold halves at step 440. The mold halves are then closed at step 450. Step 460 includes injecting a gas into the parison so that the parison takes the shape of the mold halves. The mold halves are opened and the component having an insert molded coextruded living hinge is removed in steps 470 and 480.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A component comprising:

a substrate; and a coextruded living hinge secured to the substrate, the living hinge having a spring portion and first and second arm portions, the spring portion extending circumferentially between first and second spaced apart ends such that the spring portion has a shape that is at least a semi-circle, the first arm portion mechanically bonded to and extending from the first end and the second arm portion mechanically bonded to and extending from the second end, wherein the spring portion is made of a first material and the arm portions are made of a second material, different from the first material and wherein the angle between the first and second arm portions, when at rest, is 45 to 90 degrees.

2. The component of claim 1 wherein at least one of the first and second arm portions have at least one longitudinal rib.

3. The component of claim 1 wherein the living hinge is secured to the substrate by insert molding the living hinge to the substrate.

4. The component of claim 1 wherein the spring portion is manufactured out of a thermoplastic polyester elastomer and the arm portions are coextruded out of polyvinyl chloride.

5. The component of claim 1 wherein the component is an automotive component that requires a hinge and includes at least one rib on at least one arm portion, the at least one rib facing and contacting the substrate.

6. The component of claim 1 wherein the living hinge further includes at least one rib on at least one arm portion.

7. The component of claim 1 wherein the substrate is injection molded.

8. The component of claim 1 wherein the living hinge and the substrate are compression molded together.

9. The component of claim 1 wherein the first material comprises a thermoplastic elastomer.

10. The component of claim 9 wherein the second material comprises PVC.

11. The component of claim 1 wherein the arm portions have openings therein.

12. The component of claim 1 wherein the substrate is plastic.

13. The component of claim 1 wherein the spring portion is disposed between the arm portions.

14. The component of claim 13 wherein the spring portion separates the arm portions.

15. The component of claim 1 wherein the spring body has a shape that is greater than a semi-circle.

16. The component of claim 14 wherein the angle between the arm portions, when at rest, is 60 degrees.

17. The component of claim 16 wherein the spring body has a shape that is greater than a semi-circle.

18. The component of claim 1 wherein the spring portion has a thickness generally equal to a thickness of the arm portions.

19. An automotive component for use in a vehicle, the component comprising:

a substrate; and a coextruded living hinge secured to the substrate, the living hinge having a spring portion and first and second arm portions, the spring portion extending circumferentially between a first end and a second end such that the spring portion has a shape that is a semi-circle, the first arm portion extending from the first end and the second arm portion extending from the second end, wherein the spring portion is made of a first material and the arm portions are made of a second material, different from the first material and wherein the angle between the first and second arm portions, when at rest, is 45 to 90 degrees.

20. The automotive component of claim 19 wherein the component is used in a vehicle load floor, a vehicle stowage door, or a vehicle console arm rest.

21. The automotive component of claim 19 wherein the first arm portion is integrally bonded to the first end and the second arm portion is integrally bonded to the second end.

* * * * *